US012653229B2

(12) United States Patent
Batista et al.

(10) Patent No.: US 12,653,229 B2
(45) Date of Patent: Jun. 16, 2026

(54) HYBRID AEROSOL-GENERATING DEVICE

(71) Applicant: Philip Morris Products S.A., Neuchatel (CH)

(72) Inventors: Rui Nuno Rodrigues Alves Batista, Morges (CH); Ricardo Cali, Mannheim (DE); Valerio Oliana, Pully (CH); Alexandra Sereda, Zurich (CH); Gianluca Bongiovanni, Colombier (CH); Bekele Alemu Bedasso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 399 days.

(21) Appl. No.: 18/256,148

(22) PCT Filed: Dec. 10, 2021

(86) PCT No.: PCT/EP2021/085320
§ 371 (c)(1),
(2) Date: Jun. 6, 2023

(87) PCT Pub. No.: WO2022/128826
PCT Pub. Date: Jun. 23, 2022

(65) Prior Publication Data

US 2024/0032590 A1 Feb. 1, 2024

(30) Foreign Application Priority Data

Dec. 17, 2020 (EP) ..... 20215100

(51) Int. Cl.
*A24F 40/30* (2020.01)
*A24D 1/20* (2020.01)
(Continued)

(52) U.S. Cl.
CPC ..... *A24F 40/30* (2020.01); *A24D 1/20* (2020.01); *A24F 40/10* (2020.01); *A24F 40/20* (2020.01);
(Continued)

(58) Field of Classification Search
None
See application file for complete search history.

(56) References Cited

U.S. PATENT DOCUMENTS 9,744,320 B2 8/2017 Wakalopulos
2016/0050975 A1* 2/2016 Worm ..... A45C 13/16 131/328
(Continued)

FOREIGN PATENT DOCUMENTS

CN 104770877 A 7/2015
CN 105852229 A 8/2016
(Continued)

OTHER PUBLICATIONS

KR_20190051787 English Translation (Year: 2019).*
(Continued)

*Primary Examiner* — Manley L Cummins, IV
(74) *Attorney, Agent, or Firm* — Oblon, McClelland, Maier & Neustadt, L.L.P.

(57) ABSTRACT

An aerosol-generating system is provided, including an aerosol-generating device for simultaneously generating an aerosol from first and second aerosol-forming substrates, the device including a device housing defining: first and second substrate receiving portions to respectively receive the first and the second substrates; a primary airflow path extending through the first portion; and a secondary airflow path extending through the device such that, in use, the secondary airflow path is in fluidic communication with the second substrate received in second receiving portion, the second-
(Continued)

ary airflow path merging with the primary airflow path at a junction downstream of the first portion; an aerosol-generating article including the first substrate and being receivable in the first portion; and a cartridge including the second substrate and being receivable in the second portion, the article defining a rod and an exterior wall of the rod including a fluid-permeable portion downstream of the first substrate.

13 Claims, 7 Drawing Sheets

(51) Int. Cl.

| | |
|---|---|
| ***A24F 40/10*** | (2020.01) |
| ***A24F 40/20*** | (2020.01) |
| ***A24F 40/46*** | (2020.01) |
| ***A24F 40/465*** | (2020.01) |
| ***A24F 40/485*** | (2020.01) |

(52) U.S. Cl.
CPC ..... *A24F 40/46* (2020.01); *A24F 40/465* (2020.01); *A24F 40/485* (2020.01)

(56) References Cited

U.S. PATENT DOCUMENTS

| | | | | |
|---|---|---|---|---|
| 2018/0049477 | A1 | 2/2018 | Suzuki et al. | |
| 2018/0168228 | A1 | 6/2018 | Reevell | |
| 2018/0213847 | A1* | 8/2018 | Reevell | A24F 40/30 |
| 2018/0317557 | A1 | 11/2018 | Monsees et al. | |
| 2019/0046741 | A1* | 2/2019 | Lord | A24F 40/70 |
| 2019/0098927 | A1* | 4/2019 | Mironov | A24D 1/20 |
| 2019/0183183 | A1 | 6/2019 | Ito | |
| 2020/0163376 | A1 | 5/2020 | Saygili et al. | |
| 2020/0337374 | A1* | 10/2020 | Han | A24F 40/40 |
| 2021/0000180 | A1 | 1/2021 | Hwang et al. | |
| 2021/0030981 | A1 | 2/2021 | Azzopardi et al. | |
| 2021/0177056 | A1* | 6/2021 | Yilmaz | A61M 15/06 |
| 2024/0206543 | A1* | 6/2024 | Hwang | A24D 1/027 |

FOREIGN PATENT DOCUMENTS

| | | | |
|---|---|---|---|
| CN | 108697867 | A | 10/2018 |
| CN | 110167620 | A | 8/2019 |
| CN | 110944532 | A | 3/2020 |
| CN | 111757677 | A | 10/2020 |
| EP | 3 289 895 | A1 | 3/2018 |
| EP | 3 504 988 | A1 | 7/2019 |
| EP | 3 403 518 | B1 | 3/2020 |
| JP | 2020-505041 | | 2/2020 |
| JP | 2020-078300 | | 5/2020 |
| JP | 2020-526231 | | 8/2020 |
| KR | 10-2019-0051787 | A | 5/2019 |
| RU | 2018 133 599 | A | 3/2020 |
| WO | WO2016/096745 | A1 | 6/2016 |
| WO | WO 2017/182485 | A1 | 10/2017 |
| WO | WO 2019/011937 | A1 | 1/2019 |
| WO | WO 2019/101946 | A1 | 5/2019 |

OTHER PUBLICATIONS

International Search Report & Written Opinion issued Apr. 4, 2022 in PCT/EP2021/085320 filed on Dec. 10, 2021, 10 pages.
Extended European Search Report issued Jun. 15, 2021 in European Patent Application No. 20215100.7, 8 pages.
Combined Russian Office Action and Search Report issued in corresponding Russian Patent Application No. (with English Translation of Category of Cited Documents), 10 pages.
Office Action issued in corresponding Chinese Patent Application No. 202180082996.3, dated Oct. 25, 2025, references 19-23 cited therein.
Office Action dated Dec. 15, 2025, issued in corresponding Japanese Application No. 2023-53538 (citing documents 1-3).
Office Action dated Mar. 12, 2026, issued in corresponding Chinese patent application No. 202180082996.3.

* cited by examiner

HYBRID AEROSOL-GENERATING DEVICE

The present disclosure relates to an aerosol-generating device for simultaneously generating an aerosol from a first aerosol-forming substrate and an aerosol from a second aerosol-forming substrate. The present disclosure also relates to an aerosol-generating system comprising the aerosol-generating device.

Aerosol-generating devices configured to generate an aerosol from an aerosol-forming substrate, such as a tobacco-containing substrate, are known in the art. Such known devices may generate aerosol from the substrate through the application of heat to the substrate, rather than combustion of the substrate. The aerosol-forming substrate may be present as a component part of an aerosol-generating article, in which the article is physically separate from the aerosol-generating device. In use, the aerosol-generating device may receive the aerosol-generating article. The device may provide power to enable the transfer of heat from a heat source to the aerosol-forming substrate of the aerosol-generating article. During use of such known aerosol-generating devices and aerosol-generating articles, volatile compounds are released from the aerosol-forming substrate by heat transfer from the heat source and entrained in air drawn through the aerosol-generating article. As the released compounds cool, they condense to form an aerosol that is inhaled by the consumer.

Some known aerosol-generating devices are configured to generate an aerosol from two aerosol-forming substrates simultaneously. Typically, such aerosol-generating devices are configured to receive a first, solid, aerosol-forming substrate and a second, liquid, aerosol-forming substrate. The first aerosol-forming substrate may be contained in an aerosol-forming article that comprises a rod containing a plug of solid tobacco-containing substrate at or towards a distal end of the rod, the article being receivable in a housing of the aerosol-generating device. The second aerosol-forming substrate may be contained in a separate container or cartridge also receivable in the housing of the aerosol-generating device. Such aerosol-generating devices are sometimes referred to as hybrid aerosol-generating devices.

During use of known hybrid aerosol-generating devices, volatile compounds are released from both of the first and second aerosol-forming substrates, typically as a result of heat transfer from one or more heat sources to the first and second aerosol-forming substrates. A unitary airflow path is defined through the aerosol-generating device and through the aerosol-generating article such that it passes the second aerosol-forming substrate and then through the first aerosol-forming substrate. The volatile compounds from the second aerosol-forming substrate are entrained in air in the airflow path and so these must also pass through the first aerosol-forming substrate such that the volatile compounds from the first aerosol-forming substrate are also entrained in the airflow path. As the released compounds from the first and second aerosol-forming substrates cool, they condense to form an aerosol that is inhaled by the consumer.

Hybrid aerosol-generating devices have the advantage that a user not only gets the flavour or smoking experience of the first heated aerosol-forming substrate or the second heated aerosol-forming substrate, but a combination of the two. Different combinations of first and second aerosol-forming substrates can be selected by the user to achieve a desired inhalation experience, for example to alter the flavour of the inhaled aerosols.

There are a number of problems with known hybrid systems that arise as a result of the volatile compounds from the second aerosol-forming substrate being drawn through the first aerosol-forming substrate in use. It is important that the evolved first and second aerosols mix with another before being inhaled by a consumer. But, in the prior art, the airflow management does not promote optimized mixing of the two aerosols. The blend of the two aerosols may be inconsistent during puffs or different from puff to puff.

Furthermore, when the volatile compounds of the second aerosol-forming substrate pass through the first aerosol-forming substrate they pass through a region of high temperature which can degrade the flavour second aerosol, for example because the second aerosol may undergo thermal decomposition. This is a particular problem when the aerosolization temperature of the first aerosol-forming substrate is higher than the second aerosol-forming substrate.

Furthermore, because the airflow path in known hybrid systems passes through the first aerosol-forming substrate, the resistance to draw is highly dependent on the porosity of first aerosol-forming substrate. This can mean that the resistance to draw is unacceptably or uncomfortably high for a user.

It would be desirable to provide an aerosol-generating device for simultaneously generating an aerosol from a first aerosol-forming substrate and an aerosol from a second aerosol-forming substrate in which the blend or mixture of the two aerosols is optimized and consistent between uses, in which the degradation of the flavour of the second aerosol is minimized and which has a low resistance to draw.

According to a first aspect of the present disclosure there is provided an aerosol-generating device for simultaneously generating an aerosol from a first aerosol-forming substrate and an aerosol from a second aerosol-forming substrate. The aerosol-generating device may comprise a device housing. The device housing may define a first substrate receiving portion for receiving the first aerosol-forming substrate. The device housing may define a second substrate receiving portion for receiving the second aerosol-forming substrate. The device housing may define a primary airflow path. The primary airflow path may extend through the first substrate receiving portion. The device housing may also define a secondary airflow path. The secondary airflow path may extend through the device such that, in use, the secondary airflow path is in fluidic communication with the second aerosol-forming substrate received in the second substrate receiving portion. The secondary airflow path may merge with the primary airflow path at a junction downstream of the first substrate receiving portion.

In use, a first aerosol-forming substrate may be received in the first receiving portion and a second aerosol-forming substrate may be received in the second substrate receiving portion and the device may generate volatile compounds from both the first and second aerosol-forming substrates. A user may draw air through the primary airflow path from downstream of the junction between the primary and secondary airflow paths, and so after the airflow paths have merged, such that air is drawn through both the primary and secondary airflow paths. The primary airflow path may be configured such that, when the first aerosol-forming substrate is received in the first substrate receiving portion, the primary airflow path passes through the first aerosol-forming substrate. Thus, volatile compounds released from the first aerosol-forming substrate may be entrained in the air drawn through the primary airflow path. Because the secondary airflow path is preferably in fluidic communication with the second aerosol-forming substrate received in second substrate receiving portion, volatile compounds released from the second aerosol-forming substrate may be entrained in the air drawn through the secondary airflow path. The volatile compounds from the second aerosol-forming substrate may merge with the volatile compounds from the first aerosol-forming substrate at the junction between the primary and secondary airflow paths. The volatile compounds may cool to form an aerosol which is then inhaled by a user. The volatile compounds from the first and second aerosol-forming substrates may cool to form an aerosol before or after the junction.

Because the secondary airflow path merges with the primary airflow path at a junction downstream of the first substrate receiving portion, the volatile compounds released from the secondary aerosol-forming substrate are advantageously not drawn through the primary aerosol-forming substrate. This allows for improved uniformity of the mixing between the evolved aerosols from the primary and secondary aerosol-forming substrates. The blend of the two aerosols may advantageously be consistent between puffs or uses. Furthermore, this arrangement may advantageously avoid any degradation of the volatile compounds of the second aerosol-forming substrate which might otherwise occur if those volatile compounds were to pass through the heated first substrate receiving portion. This advantageously reduces or eliminates the risk of thermal decomposition of the volatile compounds released from the second aerosol-forming substrate and may be particularly advantageous when the aerosolization temperature of the first aerosol-forming substrate receiving the in first substrate receiving portion is greater than that of the second aerosol-forming substrate.

By providing a primary and secondary airflow path in which only the primary airflow path passes through the first substrate receiving portion, the resistance to draw experienced by a user drawing air through the airflow paths is not solely dependent on the porosity of the first aerosol-forming substrate received in the first substrate receiving portion. In particular, a lower overall resistance to draw can be achieved by providing a low resistance secondary airflow path (i.e. low relative to the resistance to draw of the primary airflow path). The balance of aerosols evolved from the first and second aerosol-forming substrates inhaled by the user may be determined by the selection of the resistance to draw of secondary airflow path compared to the primary airflow path.

Preferably, the secondary airflow path is separated from the primary airflow path upstream of the junction. The two airflow paths may be separated by the device housing upstream of the junction. This separation of the airflow paths ensures that the volatile compounds released from a received second aerosol-forming substrate do not pass through a received first aerosol-forming substrate in use.

The first substrate receiving portion may be configured to receive a portion of an aerosol-generating article containing the first aerosol-forming substrate. The aerosol-generating article may be in the form of a rod, the first aerosol-forming substrate being at or towards a distal end of the rod. The rod may also comprise a mouthpiece at an opposite end of the rod to the distal end. A user of the device may draw on the mouthpiece. When the aerosol-generating article is received in the first substrate receiving portion, the primary airflow path may extend through the length of the rod, through the first aerosol-forming substrate and the mouthpiece.

The second substrate receiving portion may be configured to receive a second aerosol-forming substrate that is preferably a liquid. The second substrate receiving portion may be configured to receive a removable container or cartridge, referred to herein as the cartridge. The cartridge may form or comprise a liquid storage portion containing the second aerosol-forming substrate. A removable cartridge may advantageously be replaceable when the aerosol-forming substrate has been depleted or when it is desirable to select a cartridge containing a different second aerosol-forming substrate to achieve a different inhalation experience. Alternatively, the second substrate receiving portion may itself may form a liquid storage portion that is integral with the rest of the aerosol-generating device. In either case, the secondary airflow path may preferably be configured to be in fluidic communication with the second aerosol-forming substrate in the removable or integral liquid storage portion.

The aerosol-generating article may comprise a fluid-permeable region downstream of the first aerosol-forming substrate. The secondary airflow path may be configured to extend through the fluid-permeable region of the aerosol-generating article when the article is received in the first substrate receiving portion. The secondary airflow path may then merge with the primary airflow path.

As used herein, the term "aerosol-generating device" is used to describe a device that interacts with an aerosol-forming substrate of an aerosol-generating article to generate an aerosol. Preferably, the aerosol-generating device is a hybrid smoking device that interacts with an aerosol-forming substrate of an aerosol-generating article to generate an aerosol that is directly inhalable into a user's lungs thorough the user's mouth while simultaneously interacting with a second, preferably liquid, aerosol-forming substrate contained by or received in a second substrate receiving portion.

Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

As used herein, the term "aerosol-forming substrate" denotes a substrate consisting of or comprising an aerosol-forming material that is capable of releasing volatile compounds upon heating to generate an aerosol.

As used herein, the term "aerosol-forming material" denotes a material that is capable of releasing volatile compounds upon heating to generate an aerosol. An aerosol-forming substrate may comprise or consist of an aerosol-forming material.

As used herein, the terms "upstream" and "downstream" are used to describe the relative positions of elements, or portions of elements, of the aerosol-generating device or article in relation to the direction in which a user draws on the aerosol-generating article or device during use thereof.

The device housing may define a cavity wall defining a cavity. At least a portion of the cavity may form the first substrate receiving portion.

As used herein, a "substrate receiving portion" means the portion of the device housing configured to receive an aerosol-forming substrate. In the case of the first aerosol-forming substrate being contained at or towards the distal of an aerosol-generating article, the first substrate receiving portion is the portion of the housing immediately surrounding the first substrate when the article is received. Portions of the cavity not surrounding the first substrate when the article is received in the cavity, for example portions surrounding features of the article downstream of the substrate, do not form part of the first substrate receiving portion.

The cavity wall may advantageously comprise a shape corresponding to the shape of the aerosol-generating article that it is configured to receive. Conveniently, the cavity wall may be tubular. This may be particularly suitable when the device is intended to be used with aerosol-generating articles which define a rod form, with the tubular shape of the cavity corresponding to the geometric profile of such a rod. For example, where the aerosol-generating article is a smoking article, the use of a rod-shaped geometry for the article corresponds to that found in known smoking articles such as conventional cigarettes and electronic cigarettes. The cavity wall may be cylindrical.

As used herein, the term "rod" is used to denote a generally cylindrical element of substantially circular, oval or elliptical cross-section.

The cavity wall may comprise a fluid permeable region. The secondary airflow path may extend through the fluid permeable region. The secondary airflow path may merge with the primary airflow path within the cavity. Preferably, the fluid permeable region of the cavity wall may be downstream of the first substrate receiving portion. This advantageously ensures that air entering the cavity via the secondary airflow path does so downstream of the first receiving portion and so downstream of a first aerosol-forming substrate received in the first receiving portion. It is preferable that the fluid permeable region is provided immediately downstream of the first substrate receiving portion. This ensures maximal mixing of the first and second evolved aerosols before inhalation by a user. However, the fluid permeable region may be axially spaced from the first substrate receiving portion provided the separation is suitably low. The separation between the fluid permeable region and the first substrate receiving portion may be less than 5 millimeters, preferably less than 2 millimeters.

The fluid permeable portion of the wall of the cavity may comprise one or more of: a porous material, a plurality of slits, and a plurality of holes. By way of example and without limitation, the fluid permeable portion of the cavity wall may be provided as a mesh, with interstices of the mesh defining openings in the mesh to thereby provide permeability to air, and volatile compounds entrained in that air, flowing through the mesh. Alternatively, the fluid permeable portion may be opening provided in the cavity wall without any mesh or other restriction being present. In a further alternative, the fluid permeable portion of the cavity wall may comprise a plurality of pores, in which the plurality of pores define voids within the material of the wall. The size of any pores, slits or holes which may form part of the fluid permeable portion of the cavity wall will directly affect the permeability to fluid flow of the fluid permeable portion.

Preferably, when an aerosol-generating article comprising the first aerosol-forming substrate is received in the cavity, the fluid permeable region of the cavity wall is coincident with a corresponding fluid permeable portion of an exterior wall of the aerosol-generating article. Having the fluid permeable portions of the cavity wall of the aerosol-generating device and the exterior wall of the aerosol-generating article coinciding allows for efficient channelling of air flow from the secondary airflow path of the device into the interior of the aerosol-generating article.

As used herein, the term "fluid permeable" is used to relate to an entity which allows gases or liquids to pass through it. In particular, fluid permeable is used to refer to an entity which allows air comprising entrained volatile compounds which may have formed an aerosol to pass through. The term "fluid permeable" also encompasses a volume characteristic of a suitable material, either in relation to all or part of its volume; for example, a material having a porosity in all or part of the volume of the material.

As used herein, the term "coincident" is used to mean overlapping, either precisely or in part.

Preferably, the cavity wall is tubular. The fluid permeable portion of the cavity wall may comprise at least one annular fluid permeable band. The provision of the fluid permeable portion of the cavity wall as one or more annular bands allows for air in the secondary air flow path having entrained volatile compounds from the second aerosol-forming substrate to be channelled radially into the cavity around the periphery of the tubular cavity wall. In use, this may advantageously promote uniform mixing of the volatile compounds from the received second aerosol-forming substrate entrained in the air from the secondary airflow path with the volatile compounds from the received first aerosol-forming substrate entrained in the air of the primary airflow path. This may advantageously improve the mixing of the volatile compounds from the first and second aerosol-forming substrates. This may have the effect of improving the consistency of inhaled aerosols during the use of a device or between separate use periods.

When the device is used with an aerosol-generating article received in the cavity, with an exterior wall of the aerosol-generating article having a corresponding fluid permeable portion provided as an annular band, coinciding alignment of the annular bands of the device and the article may provide for uniform radial inflow of air into an interior of the aerosol-generating article about the periphery of the exterior wall of the article.

The cavity may be provided with an open end and a closed end. The aerosol-generating device may be configured to receive an aerosol-generating article comprising the first aerosol-forming substrate via the open end of the tubular cavity. The cavity may be configured to receive the first aerosol-forming substrate via the open end in a longitudinal direction.

The primary airflow path may extend through the cavity in a direction substantially parallel to the longitudinal axis. When an aerosol-generating article is received in the first substrate receiving portion, the primary airflow path may pass through the aerosol-forming article in a direction parallel to the longitudinal axis.

The secondary airflow path may be substantially perpendicular to the longitudinal axis where the secondary airflow path merges with the primary airflow path. In use, this may advantageously improve the mixing of the volatile compounds from the first and second aerosol-forming substrates where the primary and secondary airflow paths merge. Mixing may be optimized when the secondary airflow path merges with the primary airflow path such that the airflow paths are perpendicular to one another.

Conveniently, the aerosol-generating device may be an electrically-powered device. The aerosol-generating device may comprise a first heating means configured, in use, to heat the first aerosol-forming substrate received in the first substrate receiving portion. The first heating means may heat the first aerosol-forming substrate by either or both of inductive and resistive heating. The device may comprise a power source for supplying electrical power to the first heating means. The power source may preferably be a battery, thereby providing advantages of portability to the device. The battery may preferably be a rechargeable battery.

In some embodiments, the first heating means may be configured to heat the first substrate receiving portion such that the heat is transferred to the received first aerosol-forming substrate.

In an example of an inductive heating version of the first heating means, the first heating means may comprise an inductor coil adjacent to or surrounding the first substrate receiving portion. At least some of the first substrate receiving portion may comprise a susceptor portion. The susceptor portion may be configured to be heatable by an alternating magnetic field. In use, electrical power supplied to the inductor coil (for example, by the above-mentioned power source of the device) results in the inductor coil inducing eddy currents in the susceptor portion. These eddy currents, in turn, result in the susceptor portion of the first substrate receiving portion generating heat. The electrical power is supplied to the inductor coil as an alternating magnetic field. The alternating current may have any suitable frequency. The alternating current may preferably be a high frequency alternating current. The alternating current may have a frequency between 100 kilohertz (kHz) and 30 megahertz (MHz). When an aerosol-generating article is received in the first substrate receiving portion, the heat generated by the susceptor portion may transfer to the article to heat the first aerosol-forming substrate within the article to a temperature sufficient to cause aerosol to evolve from the substrate. The susceptor portion is formed of material having an ability to absorb electromagnetic energy and convert it into heat. By way of example and without limitation, the susceptor portion may be formed of a ferromagnetic material, such as a steel.

Preferably, the first substrate receiving portion forms at least part of a cavity wall, as described above, and the inductor coil is a helical coil that encircles the first substrate receiving portion which comprises a susceptor portion. Preferably, the inductor coil may encircle the susceptor portion radially outward of the susceptor portion. Locating the inductor coil radially outward of the susceptor portion avoids the inductor coil being damaged from contact with an aerosol-generating article during insertion of the article into the cavity.

In a variant of the inductive heating version of the first heating means outlined above, the first substrate receiving portion may lack any susceptor portion. A susceptor may instead be provided as part of the aerosol-generating article; preferably being wholly or partly encapsulated within the aerosol-forming substrate of the aerosol-generating article. In such embodiments, the device may still comprise an inductor coil which, when the first substrate receiving portion forms part of a cavity wall, preferably encircles the cavity wall radially outward of the wall.

As used herein, a "susceptor" or "susceptor portion" means a conductive element that heats up when subjected to a changing magnetic field. This may be the result of eddy currents induced in the susceptor element and/or hysteresis losses. Possible materials for the susceptor include graphite, molybdenum, silicon carbide, stainless steels, niobium, aluminium and virtually any other conductive elements. Advantageously the susceptor element is a ferrite element. The material and the geometry for the susceptor element can be chosen to provide a desired electrical resistance and heat generation. The susceptor element may comprise, for example, a mesh, flat spiral coil, fibres or a fabric. Advantageously, the susceptor is in contact with the first aerosol-forming substrate. The susceptor element may advantageously be fluid permeable.

In an example of an resistive heating version of the first heating means, the first heating means may comprise a resistive heating element. A power supply (such as the above described power supply) may be configured to supply current to the resistive heater. The resistive heating element may be arranged to encircle the first substrate receiving portion such that the resistive heating element encircles a first aerosol-forming substrate received in first substrate receiving portion. By way of example, the resistive heating element may have the form of an annular sleeve. When the first receiving portion forms part of a cavity wall, as described above, the annular sleeve may be located in or form part cavity wall.

Alternatively, the resistive heating element may be arranged to protrude into the first aerosol-forming substrate so as to, in use, be insertable into the interior of a received aerosol-generating article so as to be proximate to or in direct contact with aerosol-forming substrate of the article. By way of example, the resistive heating element may have the form of a blade. In use, electrical power would be supplied to the resistive heating element (for example, by the above-mentioned power source of the device), thereby resulting in heating of the resistive heating element. Heat may then be transferred from the resistive heating element to the first aerosol-forming substrate received in the first substrate receiving portion to heat the aerosol-forming substrate to a temperature sufficient to cause aerosol to evolve from the substrate The aerosol-generating device may further comprise a second heating means configured, in use, to heat the second aerosol-forming substrate received in the second substrate receiving portion. The second heating means may heat the second aerosol-forming substrate by either or both of inductive and resistive heating. The same power source may supply electrical power to the second heating means as to the first heating means.

In some embodiments, the second heating means may be configured to heat the second substrate receiving portion in use. Heat may then be transferred to the receiving second aerosol-forming substrate.

In an example of an inductive heating version of the second heating means, at least some of the second substrate receiving portion may comprise a susceptor portion. The device may comprise an inductor coil adjacent to or surrounding the susceptor portion. The device may further comprise a power supply configured to supply an alternating current to the inductor coil. In use, electrical power supplied to the inductor coil (for example, by the above-mentioned power source of the device) results in the inductor coil inducing eddy currents in the susceptor portion. These eddy currents, in turn, result in the susceptor portion of the second substrate receiving portion generating heat. The electrical power is supplied to the inductor coil as an alternating magnetic field. The alternating current may have any suitable frequency. The alternating current may preferably be a high frequency alternating current. The alternating current may have a frequency between 100 kilohertz (kHz) and 30 megahertz (MHz).

In an example of a resistive heating version, the second heating means may comprise a resistive heating element. The resistive heating element may be arranged to encircle the second substrate receiving portion such that the resistive heating element encircles a second aerosol-forming substrate received in the second substrate receiving portion.

Alternatively, when the second aerosol-forming substrate is contained in a replaceable cartridge receivable in the second substrate receiving portion, the aerosol-generating device may not comprise the susceptor or resistive heating element. Instead, the susceptor or resistive heating element may be provided as part of the cartridge.

In an example of an inductive heating version, a susceptor may be provided as part of the cartridge. In such embodiments, the device may still comprise an inductor coil.

In an example of a resistive heating version, a resistive heating element may be provided in the cartridge. In such embodiments, the aerosol-generating device and the cartridge may comprise electrical connections allowing for the connection between the power supply of the device with the second heating means of the cartridge when the cartridge is received in the second substrate receiving portion.

The aerosol-generating device may further comprise a controller to control the power supplied to either or both of the first and second heating means from the power supply. Thus, the controller may control heating of the first and second aerosol-forming substrates. Generally, the controller may be configured such that, when the device is in use, power is supplied to both first and second heating means and aerosol is generated simultaneously from both of the received first and second aerosol-forming substrates. In some embodiments, the controller may be configured to supply power to the first and second heating means independently so that it may be controllable which of the first and second aerosol-forming substrates is generated. This may change during a puff or use of the device.

In a second aspect of the disclosure there is provided an aerosol-generating system. The aerosol-generating system may comprise an aerosol-generating device according to the first aspect of the disclosure. The aerosol-generating system may further comprise an aerosol-generating article. The aerosol-generating article may comprise a first aerosol-forming substrate. The aerosol-generating article may be receivable in the first substrate receiving portion of the aerosol-generating. The aerosol-generating system may comprise a cartridge. The cartridge may comprise a second aerosol-forming substrate. The cartridge may be receivable in the second substrate receiving portion.

Preferably, the first aerosol-forming substrate is a solid aerosol-forming substrate. However, the first aerosol-forming substrate may comprise both solid and liquid components. Alternatively, the first aerosol-forming substrate may be a liquid aerosol-forming substrate.

Preferably, the first aerosol-forming substrate comprises nicotine. More preferably, the aerosol-forming substrate comprises tobacco. Alternatively or in addition, the aerosol-forming substrate may comprise a non-tobacco containing aerosol-forming material.

If the first aerosol-forming substrate is a solid aerosol-forming substrate, the solid first aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In a preferred embodiment, the aerosol-forming substrate comprises homogenised tobacco material. As used herein, the term "homogenised tobacco material" refers to a material formed by agglomerating particulate tobacco.

Preferably, the aerosol-forming substrate comprises a gathered sheet of homogenised tobacco material. As used herein, the term "sheet" refers to a laminar element having a width and length substantially greater than the thickness thereof. As used herein, the term "gathered" is used to describe a sheet that is convoluted, folded, or otherwise compressed or constricted substantially transversely to the longitudinal axis of the aerosol-generating article.

Preferably, the aerosol-forming substrate comprises an aerosol former. As used herein, the term "aerosol former" is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

The aerosol-generating system may comprise a first heating means configured, in use, to heat the first aerosol-forming substrate received in the first substrate receiving portion. The first heating means may heat the first aerosol-forming substrate by either or both of inductive and resistive heating. The device may comprise a power source for supplying electrical power to the first heating means. The power source may preferably be a battery, thereby providing advantages of portability to the device. The battery may preferably be a rechargeable battery.

In some embodiments, the first heating means may be configured to heat the first substrate receiving portion such that the heat is transferred to the received first aerosol-forming substrate.

Alternatively, in an example of an inductive heating version of the first heating means, a susceptor may be provided as part of the aerosol-generating article; preferably being wholly or partly encapsulated within the aerosol-forming substrate of the aerosol-generating article. In such embodiments, the device comprises an inductor coil. In use, electrical power may be supplied to the inductor coil (for example, by the above-mentioned power source of the device) which may result in the inductor coil inducing eddy currents in the susceptor. These eddy currents, in turn, may result in the susceptor generating heat which may transfer to the first aerosol-forming substrate to heat it to a temperature sufficient to cause the aerosol to evolve from the substrate.

Preferably, the aerosol-generating article defines a rod. The rod contains the first aerosol-forming substrate. An exterior wall of the rod comprises a fluid permeable portion. The fluid permeable portion of the exterior wall of the rod is positioned downstream from the first aerosol-forming substrate. The device housing of the aerosol-generating device may comprise a cavity wall defining a cavity. At least a portion of the cavity wall may form the first substrate receiving portion. The cavity wall may comprise a fluid permeable region downstream of the first substrate receiving portion. The fluid permeable portion of the rod may be configured to be coincident with the fluid permeable portion of the cavity wall when the aerosol-generating article is received in the cavity. In this way, air may be drawn through the secondary airflow path when a user inhales on a mouth end of the aerosol-generating article. The air may flow through the device housing, through the fluid permeable region of the cavity wall, through the permeable region of the exterior wall of the rod and into the interior of the rod. This air may then merge with air drawn through the primary airflow path.

Preferably, the rod of the aerosol-generating article has a mouth end and a distal end, the mouth end located downstream of the distal end. The primary airflow path of the aerosol-generating device may extend through the aerosol-generating article when it is received in a cavity of the aerosol-generating device. The primary airflow path may extend through the aerosol-forming substrate and along an interior of the rod downstream towards the mouth end such that, on application of suction at the mouth end by a user, air is drawn into the aerosol-generating article and passes through the aerosol-forming substrate along the interior of the rod downstream towards the mouth end. In use, volatile compounds may be released from the first aerosol-forming substrate to be entrained in air passing through the primary airflow path. The secondary airflow path may extend from an air inlet in the device housing and through the fluid permeable portion of the exterior wall of the rod to then merge with the second primary airflow path at a junction downstream of the first substrate receiving portion. The secondary airflow path may be in fluidic communication with the second aerosol-forming substrate received in the second substrate receiving portion such that volatile compounds released from the second aerosol-forming substrate are entrained in the air drawn through the secondary airflow path. The air with entrained volatile compounds is drawn through the fluid permeable portion of the exterior wall into a mixing region inside the rod of the aerosol-generating article of the rod. The mixing region may be downstream of and, preferably, immediately adjacent to the first aerosol-forming substrate. This ensures mixing of the volatile compounds from the first and second aerosol-forming substrates without volatile compounds from the second aerosol-forming substrate having to pass through the first aerosol-forming substrate.

Conveniently, the aerosol-forming substrate is located at the distal end, or closer to the distal end than to the mouth end.

Preferably, the interior of the rod is free of obstructions from the mixing region to the mouth end such that, in use, the mixed flow is unimpeded when flowing from the mixing region to the mouth end. By way of example, the aerosol-generating article may lack a mouthpiece filter or aerosol-cooling elements obstructing the flow path downstream towards the mouth end, as commonly found within known electronic cigarettes. The lack of any such obstructions within the interior of the rod downstream of the aerosol-forming substrate may help to reduce the resistance to draw of the primary and secondary air flow paths, and reduce the amount of suction required to be applied by a user at the mouth end in order to inhale a given amount of the mixed flow of aerosol and cooling air. Further, this may also help to reduce the manufacturing complexity for the aerosol-generating article.

The fluid permeable portion of the exterior wall of the rod may comprise one or more of a porous material, a plurality of slits, and a plurality of holes. By way of example and without limitation, the fluid permeable portion of the exterior wall of the rod may be provided as a mesh, with interstices of the mesh defining openings in the mesh to thereby provide permeability to air flow through the mesh, i.e. through the exterior wall. In a further alternative, the fluid permeable portion of the exterior wall of the rod may comprise a plurality of pores, in which the plurality of pores define voids within the material of the exterior wall. The size of any pores, slits or holes which may form part of the fluid permeable portion of the exterior wall of the rod will directly affect the permeability to air flow of the fluid permeable portion. The size of any such pores, slits or holes may be selected according to a desired volumetric flow rate of cooling air within the interior of the aerosol-generating article.

The exterior wall of the rod may be provided as a wrapper, the wrapper enclosing the first aerosol-forming substrate. By way of example, the wrapper may be a cigarette paper. The wrapper may be provided with perforations to form the fluid permeable portion of the external wall of the rod. Preferably, the wrapper has a thickness of between approximately 0.02 to 0.07 millimetres, or between approximately 0.03 to 0.05 millimetres. The aerosol-generating article defined by the rod preferably has a diameter of between approximately 3 to 10 millimetres, or between approximately 4.4 to 8 millimetres. The aerosol-generating article may have a total length of between approximately 30 millimetres and approximately 100 millimetres. Preferably, the aerosol-generating article may have a total length of between approximately 30 millimeters to approximately 60 millimeters. In a preferred embodiment, the aerosol-generating article has a total length of approximately 45 millimetres.

Preferably, the fluid permeable portion of the exterior wall of the rod comprises at least one annular fluid permeable band. The use of an annular fluid permeable band provides for uniform radial inflow of cooling air into the interior of the aerosol-generating article about the periphery of the article. This may advantageously improve the mixing of the volatile compounds from the first and second aerosol-forming substrates. This may have the effect of improving the consistency of inhaled aerosols during the use of a device or between separate use periods.

Preferably, the fluid permeable portion of the exterior wall of the rod may have an axial length of between 0.2 to 4 millimetres, or more preferably between 0.2 to 2.5 millimetres, or more preferably between 0.2 to 1.8 millimetres, or more preferably between 0.2 to 1.5 millimetres. Limiting the axial length of the fluid permeable portion of the exterior wall of the rod may assist in focussing the mixing of volatile compounds released from the first and second aerosol-forming substrates via the fluid permeable portion.

Conveniently, the fluid permeable portion of the exterior wall of the rod may extend downstream of the first aerosol-forming substrate by no more than 4 millimetres, or preferably by no more than 2.5 millimetres, or more preferably by no more than 1.8 millimetres, or more preferably by no more than 1.5 millimetres, or more preferably by no more than 0.2 millimetres. By restricting the fluid permeable portion to be extend downstream from the first aerosol-forming substrate by no more than a specified distance, mixing of the volatile compounds released from the first and second aerosol-forming substrates is able to be achieved immediately downstream of the first aerosol-forming substrate in the rod. This helps to ensure that when the mixed flow reaches the mouth end of the rod, a user receives an inhalable vapour which has been thoroughly mixed, thereby enhancing the user's experience.

The second aerosol-forming substrate contained in the cartridge is a substrate capable of releasing volatile compounds that can form an aerosol. The volatile compounds may be released by heating the second aerosol-forming substrate. The second aerosol-forming substrate may be solid or liquid or comprise both solid and liquid components. Preferably, the second aerosol-forming substrate is a liquid.

The second aerosol-forming substrate may comprise plant-based material. The second aerosol-forming substrate may comprise tobacco. The second aerosol-forming substrate may comprise a tobacco-containing material containing volatile tobacco flavour compounds, which are released from the second aerosol-forming substrate upon heating. Preferably, the second aerosol-forming substrate may alternatively comprise a non-tobacco-containing material.

The second aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants.

The second aerosol-forming substrate may be adsorbed, coated, impregnated or otherwise loaded onto a carrier or support. In one example, the aerosol-forming substrate is a liquid substrate held in capillary material. The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heater. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics materials, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary material by capillary action.

The aerosol-generating system may further comprise a second heating means configured, in use, to heat the second aerosol-forming substrate received in the second substrate receiving portion. The second heating means may heat the second aerosol-forming substrate by either or both of inductive and resistive heating. The same power source may supply electrical power to the second heating means as to the first heating means.

In an example of an inductive heating version of the second heating means, at least some of the second substrate receiving portion may comprise a susceptor portion. The device may comprise an inductor coil adjacent to or surrounding the susceptor portion. In use, electrical power supplied to the inductor coil (for example, by the above-mentioned power source of the device) results in the inductor coil inducing eddy currents in the susceptor portion. These eddy currents, in turn, result in the susceptor portion of the first substrate receiving portion generating heat. The electrical power is supplied to the inductor coil as an alternating magnetic field. The alternating current may have any suitable frequency. The alternating current may preferably be a high frequency alternating current. The alternating current may have a frequency between 100 kilohertz (kHz) and 30 megahertz (MHz).

In a variant to the inductive heating version of the second heating means outlined above, the second substrate receiving portion may lack any susceptor. A susceptor may instead be provided as part of the cartridge. In such embodiments, the device may still comprise an inductor coil.

The cartridge may comprise a housing, an external surface of which surrounds the aerosol-forming substrate. At least a portion of the external surface may be formed by a fluid permeable susceptor element. The susceptor element may have a plurality of openings formed in it to allow fluid to permeate through it. In particular, the susceptor element may allow the aerosol-forming substrate, in either gaseous phase or both gaseous and liquid phase, to permeate through it. The susceptor element may be in the form of a sheet that extends across an opening in the cartridge housing. The susceptor element may extend around a perimeter of the cartridge housing. The susceptor element may be provided on a wall of the cartridge housing that is configured to be positioned adjacent the inductor coil when the cartridge housing is engaged with the device housing. In use, it is advantageous to have the susceptor element close to the inductor coil in order to maximise the voltage induced in the susceptor element.

In an example of a resistive heating version of the second heating means, the cartridge comprises a resistive heating element. The resistive heating element may be arranged to encircle the second substrate receiving portion such that the resistive heating element encircles a first aerosol-forming substrate received in first substrate receiving portion. Alternatively, the resistive heating element may be provided as part of the cartridge. In such embodiments, the aerosol-generating device and the cartridge may comprise electrical connections allowing for the connection between the power supply of the device with the second heating means of the cartridge when the cartridge is received in the second substrate receiving portion.

When the cartridge comprises a capillary material, as described above, the capillary material may be configured to convey the second aerosol-forming substrate to the susceptor element or the resistive heating element of the cartridge.

The invention is defined in the claims. However, below there is provided a non-exhaustive list of non-limiting examples. Any one or more of the features of these examples may be combined with any one or more features of another example, embodiment, or aspect described herein.

EX1. An aerosol-generating device for simultaneously generating an aerosol from a first aerosol-forming substrate and an aerosol from a second aerosol-forming substrate, the aerosol-generating device comprising a device housing, the device housing defining:

a first substrate receiving portion for receiving the first aerosol-forming substrate and a second substrate receiving portion for receiving the second aerosol-forming substrate;

a primary airflow path extending through the first substrate receiving portion; and a secondary airflow path extending through the device such that, in use, the secondary airflow path is in fluidic communication with the second aerosol-forming substrate received in second substrate receiving portion;

wherein the secondary airflow path merges with the primary airflow path at a junction downstream of the first substrate receiving portion.

EX2. An aerosol-generating device according to example EX1, wherein the secondary airflow path is separated from the primary airflow path upstream of the junction.

EX3. An aerosol-generating device according to example EX1 or EX2, wherein the first substrate receiving portion is configured to receive a portion of an aerosol-generating article containing the first aerosol-forming substrate.

EX4. An aerosol-generating device according to any one of examples EX1 to EX3, wherein the second substrate receiving portion is configured to receive a second aerosol-forming substrate.

EX5. An aerosol-generating device according to example EX4, wherein the second substrate receiving portion is configured to receive a removable container or cartridge comprising a liquid storage portion containing the second aerosol-forming substrate.

EX6. An aerosol-generating device according to example EX4, wherein the second substrate receiving portion forms a liquid storage portion that is integral with the rest of the aerosol-generating device.

EX7. An aerosol-generating device according to any one of examples EX1 to EX6, wherein the device housing defines a cavity wall defining a cavity and wherein at least a portion of the cavity forms the first substrate receiving portion.

EX8. An aerosol-generating device according to example EX7, wherein the cavity wall may advantageously comprise a shape corresponding to the shape of the aerosol-generating article that it is configured to receive.

EX9. An aerosol-generating device according to example EX8, wherein the cavity wall is tubular.

EX10. An aerosol-generating device according to example EX8 or EX9, wherein the cavity wall is cylindrical.

EX11. An aerosol-generating device according to any one of examples EX7 to EX10, wherein the cavity wall comprises a fluid permeable region.

EX12. An aerosol-generating device according to example EX11, wherein the fluid permeable region of the cavity wall is downstream of the first substrate receiving portion.

EX13. An aerosol-generating device according to example EX11 or EX12, wherein the fluid permeable region is provided immediately downstream of the first substrate receiving portion.

EX14. An aerosol-generating device according to example EX11 or EX12, wherein the fluid permeable region is axially spaced from the first substrate receiving portion and the separation between the fluid permeable region and the first substrate receiving portion is less than 5 millimeters, preferably less than 2 millimeters.

EX15. An aerosol-generating device according to any one of examples EX11 to EX14, wherein the fluid permeable portion of the wall of the cavity comprises one or more of: a porous material, a plurality of slits, and a plurality of holes.

EX16. An aerosol-generating device according to any one of examples EX11 to EX15, wherein the cavity wall is tubular and the fluid permeable portion of the cavity wall comprises at least one annular fluid permeable band.

EX17. An aerosol-generating device according to any one of examples EX7 to EX16, wherein the cavity is provided with an open end and a closed end.

EX18. An aerosol-generating device according to example EX17, wherein the aerosol-generating device is configured to receive an aerosol-generating article comprising the first aerosol-forming substrate via the open end of the tubular cavity in a longitudinal direction.

EX19. An aerosol-generating device according to example EX18, wherein the primary airflow path extends through the cavity in a direction substantially parallel to the longitudinal axis.

EX20. An aerosol-generating device according to example EX18 or EX19, wherein the secondary airflow path is substantially perpendicular to the longitudinal axis where the secondary airflow path merges with the primary airflow path.

EX21. An aerosol-generating device according to any one of examples EX1 to EX20, wherein the aerosol-generating device comprises a first heating means configured, in use, to heat the first aerosol-forming substrate received in the first substrate receiving portion.

EX22. An aerosol-generating device according to example EX21, wherein the first heating means is heat the first aerosol-forming substrate by either or both of inductive and resistive heating and the device comprises a power source for supplying electrical power to the first heating means.

EX23. An aerosol-generating device according to example EX22, wherein the power source is a battery.

EX24. An aerosol-generating device according to example EX23, wherein the battery is a rechargeable battery.

EX25. An aerosol-generating device according to any one of examples EX21 to EX24 wherein the first heating means comprises an inductor coil adjacent to or surrounding the first substrate receiving portion.

EX26. An aerosol-generating device according to example EX25, wherein at least some of the first substrate receiving portion comprises a susceptor portion.

EX27. An aerosol-generating device according to example EX26, wherein the first substrate receiving portion forms at least part of a cavity wall.

EX28. An aerosol-generating device according to any one of examples EX25 to EX27, wherein the inductor coil is a helical coil that encircles the first substrate receiving portion which comprises a susceptor portion.

EX29. An aerosol-generating device according to example EX28, wherein the inductor coil encircles the susceptor portion radially outward of the susceptor portion.

EX30. An aerosol-generating device according to any one of examples EX21 to EX24, wherein the first heating means comprises a resistive heating element.

EX31. An aerosol-generating device according to example EX30, wherein the resistive heating element is arranged to encircle the first substrate receiving portion such that the resistive heating element encircles a first aerosol-forming substrate received in first substrate receiving portion.

EX32. An aerosol-generating device according to example EX30 or EX31, wherein the resistive heating element has the form of an annular sleeve.

EX33. An aerosol-generating device according to example EX30, wherein the resistive heating element is arranged to protrude into the first aerosol-forming substrate so as to, in use, be insertable into the interior of a received aerosol-generating article.

EX34. An aerosol-generating device according to example EX33, wherein the resistive heating element may have the form of a blade.

EX35. An aerosol-generating device according to any one of examples EX21 to EX34, further comprising a second heating means configured, in use, to heat the second aerosol-forming substrate received in the second substrate receiving portion.

EX36. An aerosol-generating device according to example EX35, wherein the second heating means is configured to heat the second aerosol-forming substrate by either or both of inductive and resistive heating.

EX37. An aerosol-generating device according to example EX35 or EX36, wherein at least some of the second substrate receiving portion may comprise a susceptor portion.

EX38. An aerosol-generating device according to example EX35 or EX36, wherein the second heating means comprises a resistive heating element.

EX39. An aerosol-generating device according to example EX38, wherein the resistive heating element is arranged to encircle the second substrate receiving portion such that the resistive heating element encircles a second aerosol-forming substrate received in the second substrate receiving portion.

EX40. An aerosol-generating system comprising:

an aerosol-generating device according to any one of examples EX1, to EX39;

an aerosol-generating article comprising a first aerosol-forming substrate, the aerosol-generating article being receivable in the first substrate receiving portion of the aerosol-generating device; and a cartridge comprising a second aerosol-forming substrate, the cartridge being receivable in the second substrate receiving portion.

EX41. An aerosol-generating system according to example EX40, wherein the first aerosol-forming substrate is a solid aerosol-forming substrate.

EX42. An aerosol-generating system according to examples EX40 or EX41, wherein the first aerosol-forming substrate comprises nicotine.

EX43. An aerosol-generating system according to any one of examples EX40 to EX42, wherein the aerosol-forming substrate comprises tobacco.

EX44. An aerosol-generating system according to any one of examples EX40 to EX43, wherein the aerosol-generating article defines a rod.

EX45. An aerosol-generating system according to examples EX44, wherein the rod contains the first aerosol-forming substrate.

EX46. An aerosol-generating system according to example EX45 or EX46, wherein an exterior wall of the rod comprises a fluid permeable portion.

EX47. An aerosol-generating system according to example EX46, wherein the fluid permeable portion of the exterior wall of the rod is positioned downstream from the first aerosol-forming substrate.

EX48. An aerosol-generating system according to examples EX47, wherein the device housing of the aerosol-generating device comprises a cavity wall defining a cavity, at least a portion of the cavity wall forming the first substrate receiving portion, the cavity wall comprising a fluid permeable region downstream of the first substrate receiving portion and wherein the fluid permeable portion of the rod is configured to be coincident with the fluid permeable portion of the cavity wall when the aerosol-generating article is received in the cavity.

EX49. An aerosol-generating system according to any of examples EX46 to EX48, wherein the rod of the aerosol-generating article has a mouth end and a distal end, the mouth end located downstream of the distal end.

EX50. An aerosol-generating system according to example EX49, wherein the first aerosol-forming substrate is located at the distal end, or closer to the distal end than to the mouth end.

EX51. An aerosol-generating system according to any one of examples EX46 to EX50, wherein the fluid permeable portion of the exterior wall of the rod may comprise one or more of a porous material, a plurality of slits, and a plurality of holes.

EX52. An aerosol-generating system according to any one of examples EX46 to EX51, wherein the fluid permeable portion of the exterior wall of the rod comprises at least one annular fluid permeable band.

Examples will now be further described with reference to the figures, in which.

Figure 4:
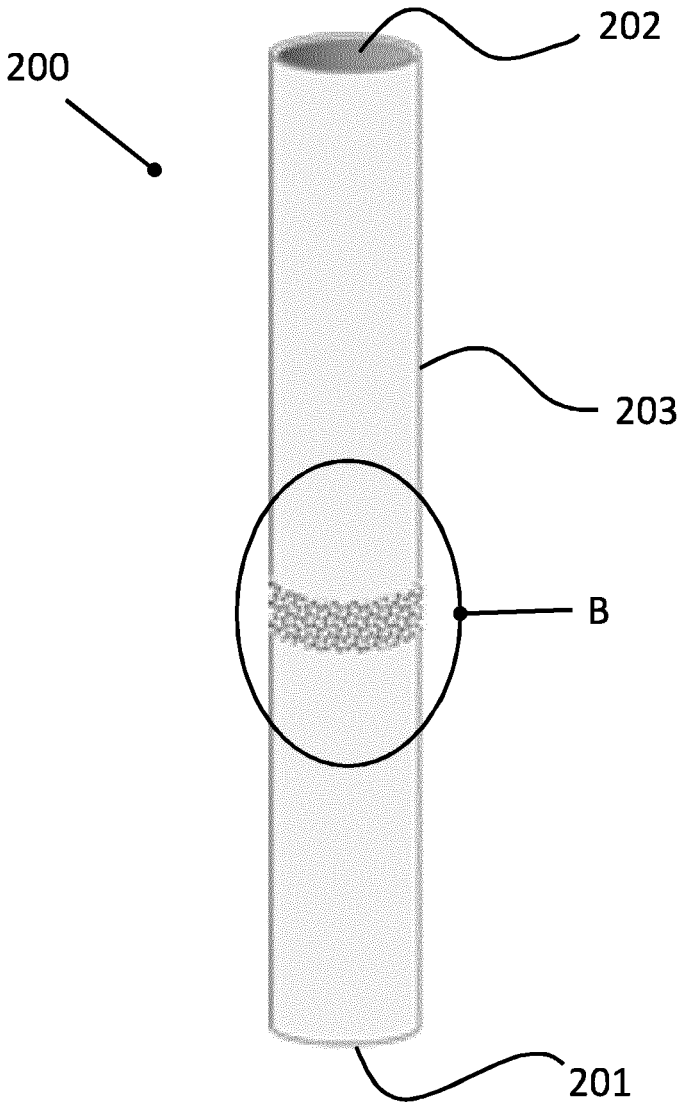
FIG. 4 illustrates a perspective view of the aerosol-generating article of FIG. 2.
Figure 5:
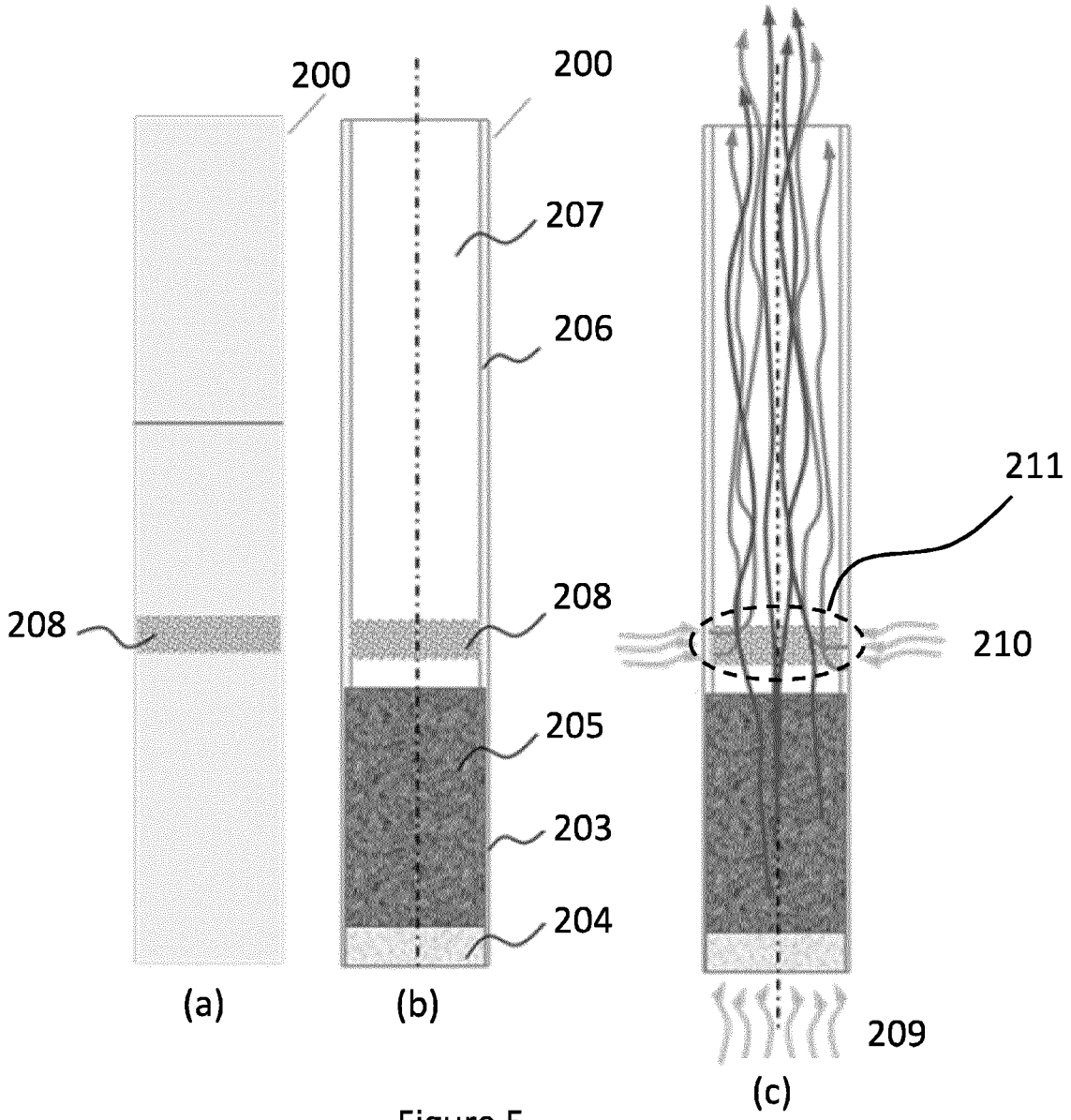
Figure 6:
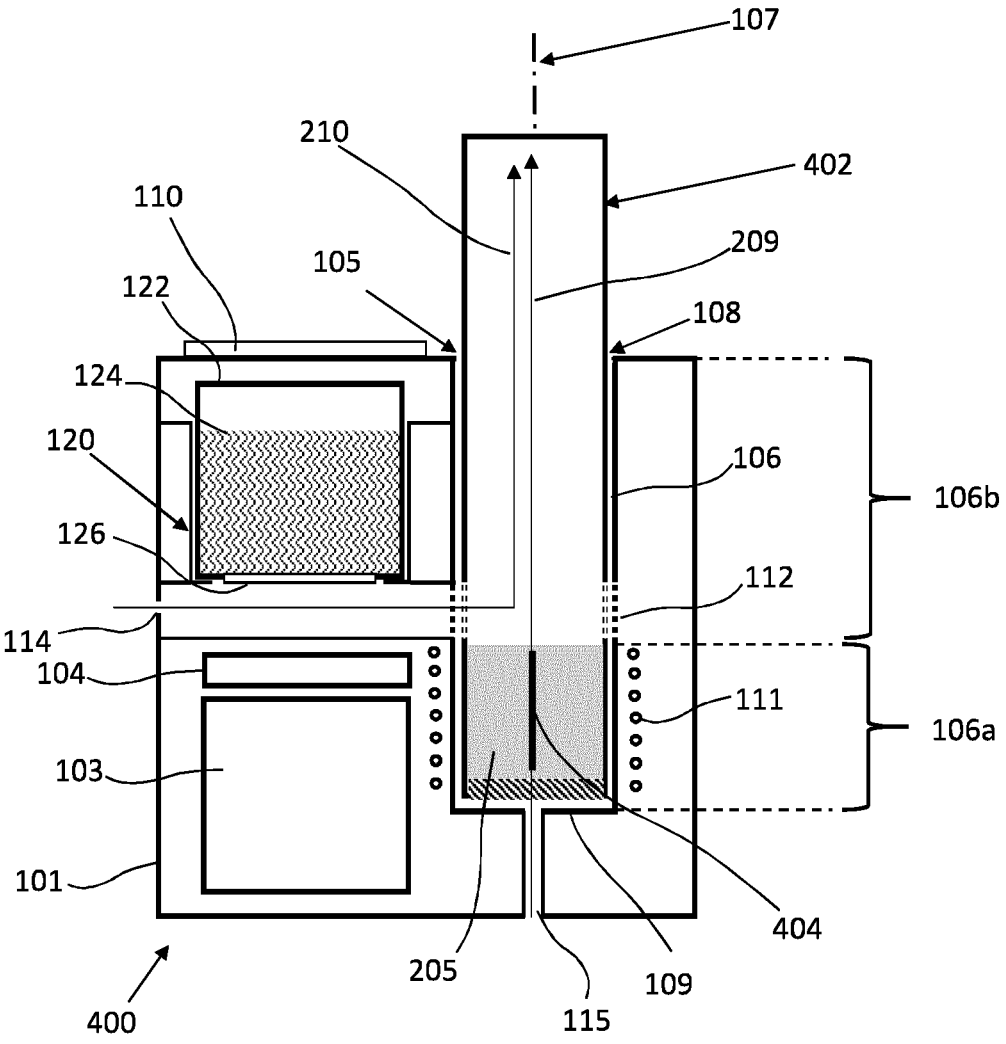
Figure 7:
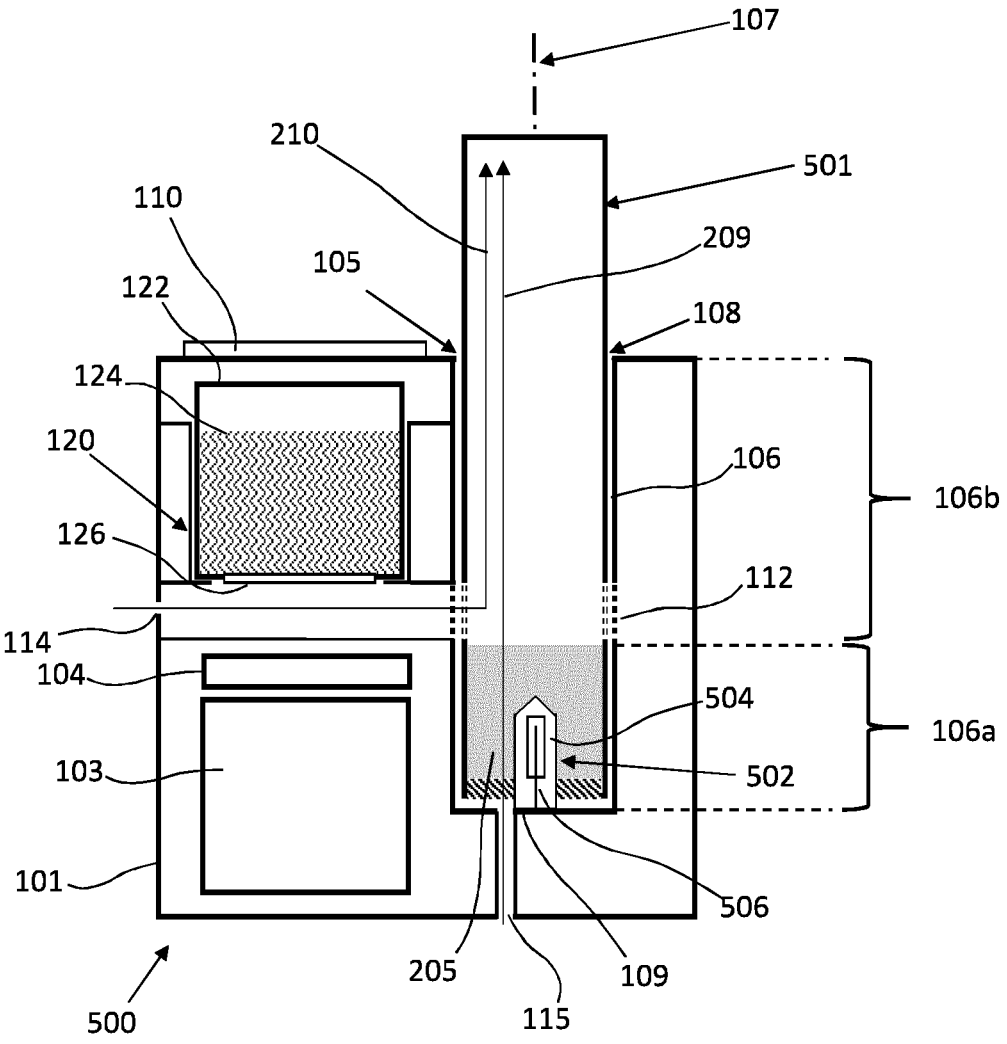

FIGS. 5*a*, 5*b* and 5*c* illustrate three different side elevation views of the aerosol-generating article of FIG. 4;

FIG. 6 illustrates a schematic cross-sectional view of a second embodiment of an aerosol-generating device according to the present disclosure an aerosol-generating article and a cartridge are received in the aerosol-generating device; and FIG. 7 illustrates a schematic cross-sectional view of a third embodiment of an aerosol-generating device according to the present disclosure an aerosol-generating article and a cartridge are received in the aerosol-generating device.

Figure 1:
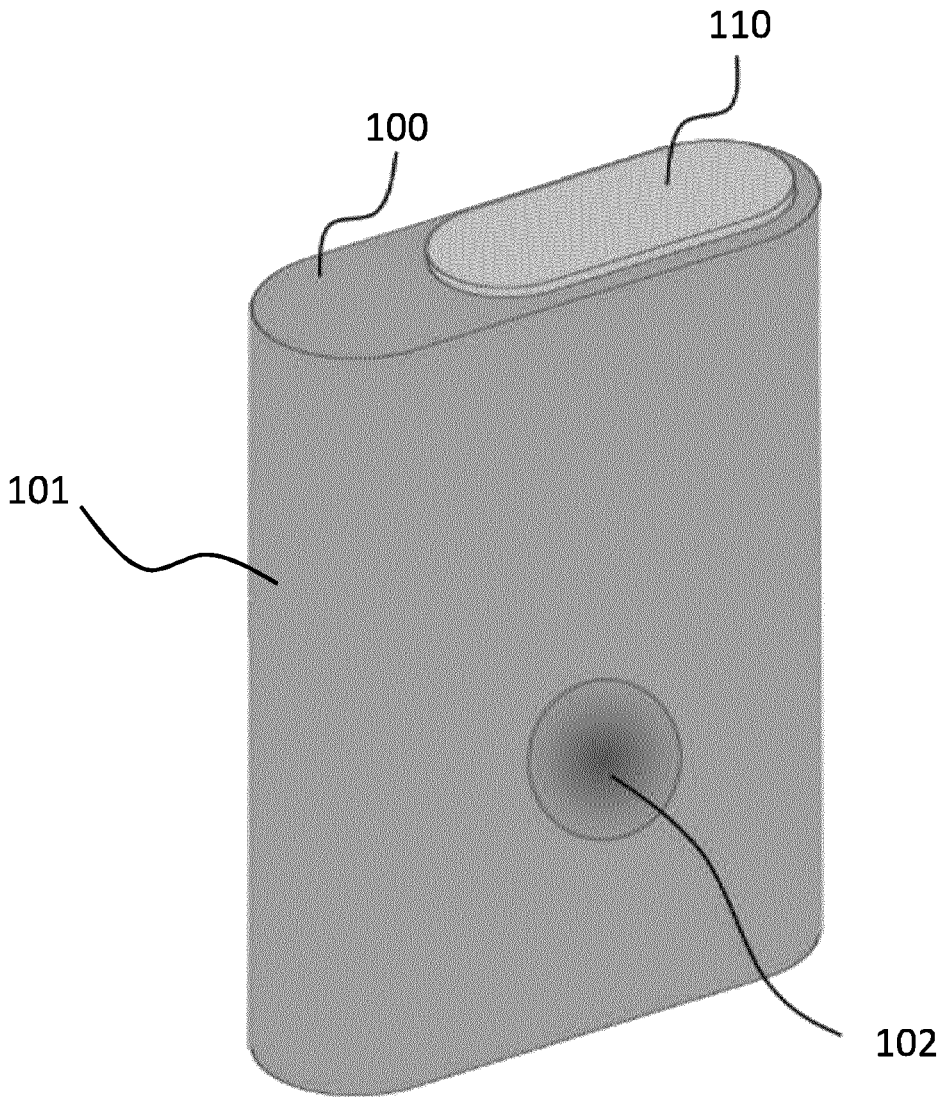
FIG. 1 illustrates a perspective view of an aerosol-generating device according to the present disclosure.

FIG. 1 shows an aerosol-generating device 100. The device 100 has a housing 101. An activation button 102 is incorporated into the housing 101.

Figure 2:
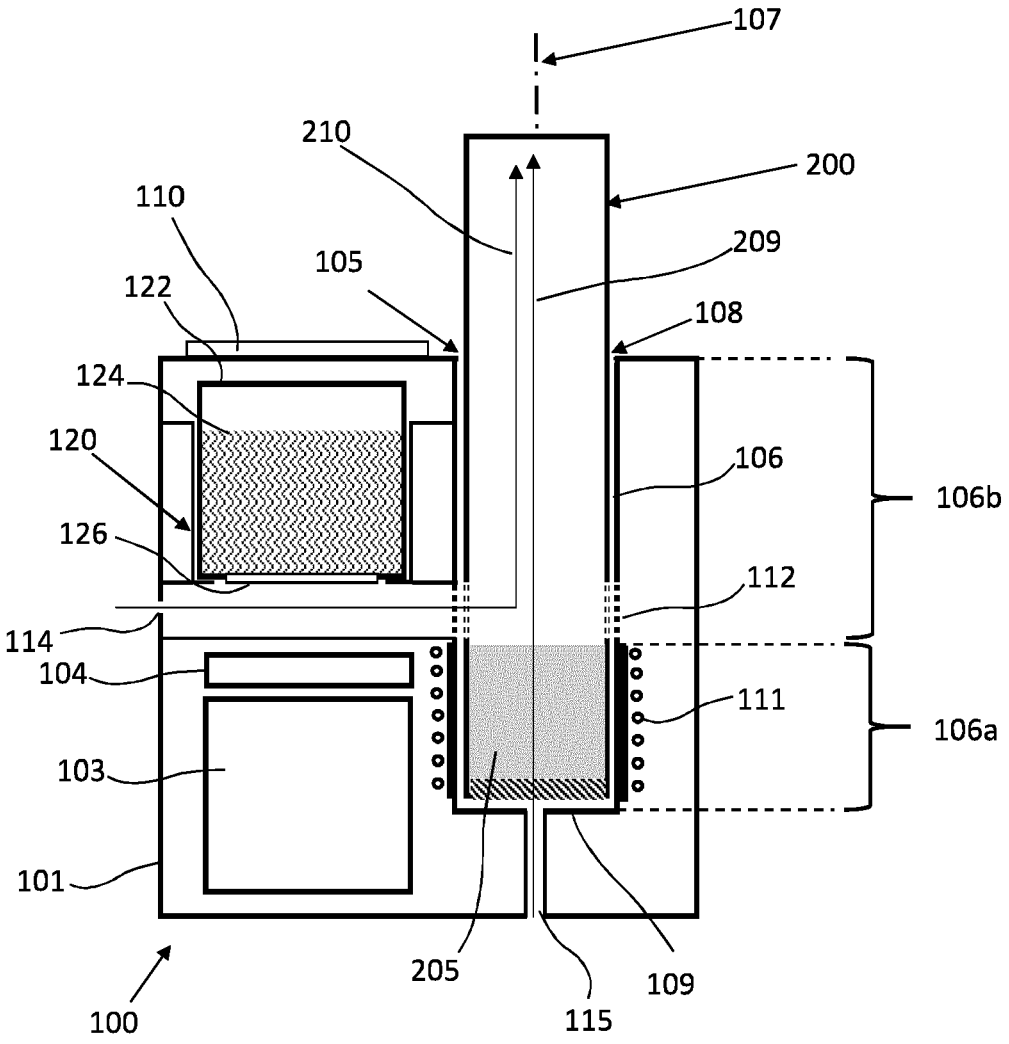
FIG. 2 illustrates a schematic cross-sectional view of the aerosol-generating device of FIG. 1, in FIG. 2 an aerosol-generating article and a cartridge are received in the aerosol-generating device, the aerosol-generating device, aerosol-generating article and cartridge together forming an aerosol-generating system.

As shown in FIG. 2, a power source in the form of a rechargeable battery 103 is located within the housing 101. Control electronics 104 are also located within the housing 101. The control electronics 104 are positioned adjacent the rechargeable battery 103. The housing 101 has a tubular cavity 105 extending within an interior of the device 100. The cavity 105 is defined by a tubular cavity wall 106 extending within the device 100 along longitudinal axis 107. The cavity 105 has an open end 108 and a closed end 109, with the open and closed ends located at opposite ends of the cavity. The cavity 105 is configured to receive an aerosol generating article 200 via the open end 108 along the longitudinal axis 107. In FIG. 2, an aerosol-generating article 200 comprising a first aerosol-forming substrate 205 is received in the cavity. The housing 101 is provided with a slidable cover 110 which can be moved to expose or close the open end 108 of the cavity 105. In FIG. 1, the cover 110 is shown in a closed position in which the open end of the cavity 105 is closed. In FIG. 2, the cover 110 is shown in an open position in which the open end of the cavity 105 is open and so able to receive the aerosol-generating article 200.

Figure 3:
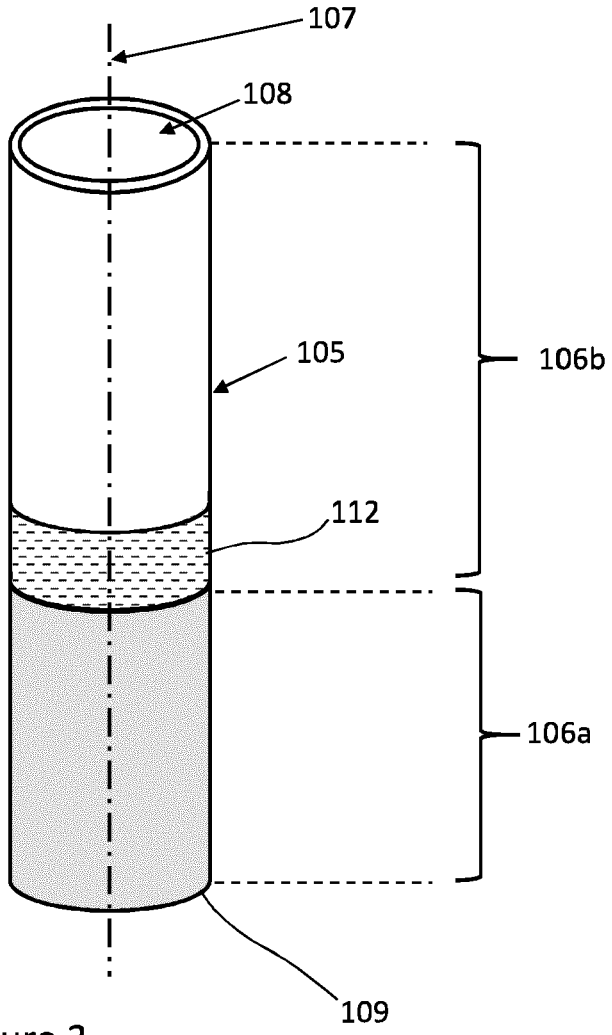
FIG. 3 illustrates a perspective view of cavity of the aerosol-generating device of FIGS. 1 and 2, shown separately from the rest of the device.

As shown in FIGS. 2 and 3, the tubular cavity wall 106 has a lower portion 106*a* and an upper portion 106*b*. The lower portion 106*a* is first substrate receiving portion, configured for receiving a distal end of the aerosol-generating article 200 which contains an aerosol-forming substrate. The lower portion 106*a* is formed of a different material to the upper portion 106*b*. The lower portion 106*a* is formed of a material having an ability to absorb electromagnetic energy and convert it into heat. So, for this embodiment, the lower portion 106*a* is a susceptor portion. Accordingly, the terms lower portion and susceptor portion are used here interchangeably for reference sign 106*a*. In this example, the susceptor portion 106*a* is formed of a steel. However, in other embodiments (not shown), the susceptor portion 106*a* may be formed of other materials having an ability to absorb electromagnetic energy and convert it into heat. In other embodiments, the lower portion 106*a* (i.e. the first substrate receiving portion) may only be partially formed of a material having an ability to absorb electromagnetic energy and convert it to heat. The rest of the lower portion 106*a* may be formed of a thermally conductive material suitable for conducting heat away from the susceptor portion and towards the receiving aerosol-generating article. In any case, an inductor coil 111 circumferentially encircles the lower portion 106*a*.

The upper portion 106*b* of the tubular wall 106 is formed of a polymeric material. An annular region of the upper portion 106*b* of the tubular wall 106 of the cavity 105 is provided with a homogenous distribution of holes extending radially through the tubular wall to form an annular fluid permeable band 112. The annular fluid permeable band 112, and the susceptor portion 106*a*, are shown more clearly in FIG. 3.

As shown in FIG. 2, a single air inlet 115 is provided in the bottom surface of the housing 101 directly beneath the closed end 109 of the cavity 105, with a primary airflow channel 209 extending from the air inlet 115 to an opening formed in the closed end 109 of the cavity 105 and then through the cavity 105 and, in particular, through the aerosol-generating article 200 received in the cavity. Fluid flow lines are included in FIG. 2 showing how air entering through the air inlet 115 fluidically communicates with the closed end 109 of the cavity 105.

The aerosol-generating device further comprises a second substrate receiving portion 120. As shown in FIG. 2, a cartridge 122 containing a second aerosol-forming substrate 124 is received in the second substrate receiving portion. The second aerosol-forming substrate 124 is a liquid and so the cartridge 122 may be considered a liquid storage portion. The cartridge 122 is removable from the second substrate receiving portion 120 in the embodiment illustrated in FIG. 2. In other embodiments, the second receiving portion 120 may itself form a liquid storage portion that is integral with the rest of the device.

As shown in FIG. 2, the cartridge 122 further comprises a heater element 126. In this embodiment, the heater element 126 is a resistive heater element and is fluid permeable. The resistive heater element is connectable to the battery via electrical contacts on the cartridge 122 which are connectable to electrical contacts located in the second substrate receiving portion 120. The electrical contacts of the cartridge contact those of the second substrate receiving portion when the cartridge 122 is received in the substrate receiving portion 120. The electrical contacts are not shown, nor are any wires connecting the electrical contacts of the second substrate receiving portion 120 to the battery or connecting the electrical contacts of the cartridge to the resistive heater element 126.

The second aerosol-forming substrate 124 is supplied to the heater element 126 under the action of gravity. A capillary material (not shown) may also be provided in the cartridge in which the second aerosol-forming substrate 124 may be held. The capillary material may transport the second aerosol-forming substrate 124 to the heater element 126. The capillary element may fill the cartridge 122.

In some embodiments, the resistive heater element 126 may be replaced with a susceptor element and the device may comprise a second inductor coil configured, in use, to generate heat in that susceptor element. In some embodiments, the heater element may be provided in the second receiving portion rather than the cartridge such that heat can be conducted from the second receiving portion to the cartridge.

As shown in FIG. 2, a secondary airflow path is defined between an air inlet 114 provided in a sidewall of the housing 101. As indicated by fluid flow lines in FIG. 2, air entering the housing 101 through air inlet 114 flows through the interior of the housing to fluidically communicate with the annular fluid permeable band 112. The secondary airflow path passes the fluid permeable heater element 126. Thus, the secondary airflow path is in fluidic communication with the second aerosol-forming substrate 124 contained in the cartridge 122 when the cartridge is received in the second substrate receiving portion 120 (as shown in FIG. 2).

The aerosol-generating article 200 is shown more clearly in the perspective view of FIG. 4. The aerosol-generating article 200 has the form of an elongate cylindrical rod. Accordingly, the terms aerosol-generating article and rod are used here interchangeably for reference sign 200. The aerosol-generating article 200 has a distal end 201 and a mouth end 202. The aerosol-generating article 200 has a wrapper 203 of cigarette paper. The wrapper 203 forms an exterior wall of the rod 200. As shown in FIGS. 5*b* and 5*c*, a porous front-plug 204, a plug of aerosol-forming substrate 205 and a tubular core element 206 are assembled sequentially and coaxially within the wrapper 203. The porous front-plug 204 is located at the distal end 201. The plug of aerosol-forming substrate 205 is positioned immediately downstream of the front-plug. The tubular core element 206 is positioned immediately downstream of the plug of aerosol-forming substrate 205 and extends towards the mouth end 202. In the embodiment shown, the hollow interior 207 of the tubular core element 206 is free of obstructions such as a mouthpiece filter element, to define an empty space. So, the hollow interior 207 means that the interior of the rod 200, between the downstream end of the aerosol-forming substrate 205 and the mouth end 202, defines an unobstructed flow path. However, in an alternative embodiment (not shown), a filter element may be located within the rod 200 adjacent the mouth end 202. For the embodiment shown and described herein, the aerosol-forming substrate 205 is a solid substrate containing tobacco. An annular region of the wrapper 203 is provided with a homogenous distribution of holes extending radially through the tubular wall to form an annular fluid permeable band 208 in the wrapper 203 (i.e. the exterior wall) of the rod 200.

The aerosol-generating article 200 shown in the figures and described herein is a smoking article intended for use with the aerosol-generating device 100, so as to generate aerosol from the aerosol-forming substrate 205 for inhalation by a user. The aerosol-generating device 100 is reusable, whereas the aerosol-generating article 200 is disposable and intended for single-use only.

The primary airflow path 209, referred to above, extends through the aerosol-forming substrate 205 and along the hollow interior of the tubular core element 206. The secondary air flow path 210 extends through the annular fluid permeable band 208 to a mixing region 211 located within the rod 200. The mixing region 211 is where the primary and secondary airflow paths 209, 210 coincide and merge, their respective fluid flows mixing and combining with each other, as will be described in more detail below.

In use, a user would first slide the slidable cover 110 to expose the open end 108 of the cavity 105. The user would then insert a fresh, unused aerosol-generating article 200 into the cavity 105 via the open end 108, until the distal end 201 of the article touches the closed end 109 of the cavity. In this position, the aerosol-generating article 200 is said to be received in the cavity 105 of the aerosol-generating device 200. A user may also insert or replace a removable cartridge into the second substrate receiving portion 220. However, because the removable cartridge will typically contained enough second aerosol-forming substrates for several uses, this may not be necessary. The combination of the aerosol-generating device 100, the cartridge 122 and the aerosol-generating article 200 form an aerosol-delivery system. When the aerosol-generating article 200 is received within the cavity 106, the annular fluid permeable band 112 of the tubular wall 106 of the cavity 105 is coincident with the annular fluid permeable band 208 of the wrapper 203 of the aerosol-generating article 200. Further, when the aerosol-generating device 200 is received within the cavity 106, the plug of aerosol-forming substrate 205 is located wholly within the susceptor portion **106*b* (i.e. the first substrate receiving portion) and the inductor coil 111**.

Upon the user pressing the activation button 102, the control electronics 104 control the supply of electrical power from the rechargeable battery 103 to the inductor coil 111 and to the heater element 126. The resulting flow of electrical current through the inductor coil 111 induces eddy currents into the steel susceptor portion **106*a*. These eddy currents, in turn, result in heating of the susceptor portion 106*a*. Heat from the susceptor portion 106*a* radiates onto the aerosol-generating article 200 housed within the cavity 105. As the plug of aerosol-forming substrate 205 is located wholly within the susceptor portion 106*a* and the inductor coil 111, heat from the susceptor portion radiates onto the wrapper 203 of the aerosol-generating article 200 and is conducted to the plug of aerosol-forming substrate 205. The consequent heating of the aerosol-forming substrate 205 results in the substrate evolving a first aerosol. Simultaneously, the flow of electrical current through resistive heating element 126 causes the heating element to heat up. Heat from the heating element 126 is transferred to the second aerosol-forming substrate 124 in contact with or near to the heating element 126. The consequent heating of the aerosol-forming substrate 120** results in the substrate evolving a second aerosol.

The control electronics 104 are configured so as to adjust the temperature of the susceptor portion **106*b* and the heating element 126 according to predetermined thermal profiles, which are optimized respectively for the first and second aerosol-forming substrates. Once the susceptor portion 106*a* has attained a sufficiently high temperature to result in aerosol being evolved from the plug of aerosol-forming substrate 205 and the heating element 126 has attained a sufficiently high temperature to result in aerosol being evolved from the aerosol-forming substrate contained in the cartridge 120, the user may then draw on the mouth end 202 of the aerosol-generating article 200 so as to apply suction to the mouth end. Each draw taken by the user on the aerosol-generating article 200** is commonly referred to as a "puff".

The suction resulting from the user drawing on the mouth end 202 results in air being sucked into the aerosol-generating device 100 via inlet opening 115 and through the primary airflow path 209 so as to be conveyed through the closed end 109 of the cavity 105 and to enter the aerosol-generating article 200 through the porous front plug 204 and onwards through the plug of aerosol-forming substrate 205. This air becomes entrained with aerosol evolved from the first aerosol-forming substrate 205 due to heating by the susceptor portion **106*a* and continues to flow along first air flow path 209 to emerge from a downstream end of the plug of aerosol-forming substrate 205 into the mixing region 211**.

The suction resulting from the user drawing on the mouth end 202 also results in external air being sucked into the housing 101 of the aerosol-generating device 100 via air inlet 114 to pass through the secondary airflow path 210 and so within the interior of the housing 101 and past the heater element 126. As the air passes the heater element 126, the air become entrained with aerosol evolved from the second aerosol-forming substrate 124 due to heating by the heater element. The air then continues onwards to and through the annular fluid permeable band 112 defined in the upper portion **106*b* of the tubular wall 106 of the cavity 105. The coinciding alignment of the annular fluid permeable band 112 defined in the tubular wall 106 of the cavity 105 of the device 100 with the annular fluid permeable band 208 defined in the wrapper 203 of the aerosol-generating article 200 results in much of the air flowing through fluid permeable band 112 then passing across a radial gap separating tubular wall 106 and article 200 and along the second air flow path 210 through the fluid permeable band 208. In this manner, air having entrained aerosol evolved from the second aerosol-forming substrate is able to be fed through the interior of the housing 101 of the aerosol-generating device 100 and then be fed to within the aerosol-generating article 200 received in the cavity 105. On passing through the annular fluid permeable band 208 defined in the wrapper 203 of the article 200, the air entrained with evolved aerosol from the second aerosol-forming substrate enters the mixing region 211**.

In the mixing region 211, the heated aerosol evolved from the first aerosol-forming substrate flowing along the first air flow path 209 mixes with the heated aerosol evolved from the second aerosol-forming substrate flowing along the secondary air flow path 210. Importantly, because the fluid permeable band 112 is downstream of the first substrate receiving portion **106*a*, and the fluid permeable band 208 of the aerosol-generating article, is downstream of the first aerosol-forming substrate 205, the aerosol evolved from the second aerosol-forming substrate does not pass through the first aerosol-forming substrate. Instead, the second aerosol enters the mixing chamber immediately downstream of the first aerosol-forming substrate. This promotes optimal mixing of the first and second aerosol. The mixed flow cools in the mixing chamber and then flows downstream along the hollow interior 207 of the tubular core element 206 of the aerosol-generating article and towards the mouth end 202** to be inhaled by the user.

For the aerosol-generating article 200 shown in the figures, the annular fluid permeable band 208 has an axial length $L_{208}$ of 4 millimetre, with the upstream end of the annular band 208 being coincident with the downstream end of the plug of aerosol-forming substrate 205. In alternative embodiments, the axial length L208 may be as little as 0.2 millimetres. The aerosol-generating article 200 shown in the figures has a length of between approximately millimetres and approximately 100 millimetres.

FIG. 6 illustrates a second embodiment of the aerosol-generating device 400. Many of the features of the aerosol-generating device 400 of FIG. 6 are the same as those of FIG. 2 with the same reference numerals being used for identical features. The difference in this embodiment is that the device 400 does not comprise a susceptor element. Instead, a susceptor 402 is provided within the substrate of the aerosol-generating article 404. The susceptor 402 is made of steel. Because the susceptor 402 is within the substrate of the aerosol-generating article, when the article is received in the cavity 105, it is surrounded by the inductor coil 111. Thus, in use, the inductors coil 111 induced eddy currents in the steel susceptor 402 which result in heating of the susceptor 402 and resulting in the substrate evolving a first aerosol. The control electronics 104 are configured so as to adjust the temperature of the susceptor 402 according to a predetermined thermal profile.

Otherwise, the aerosol-generating device 400 operates similarly to the aerosol-generating device 100, with the aerosol evolved from the first aerosol-forming substrate being entrained in air passing through the primary airflow path to mix with air passing through the secondary airflow path in the mixing region, downstream of the first aerosol-forming substrate, to then be inhaled by a user.

FIG. 7 illustrates a third embodiment of the aerosol-generating device 500. Many of the features of the aerosol-generating device 500 of FIG. 7 are the same as those of FIG. 2 with the same reference numerals being used for identical features. The difference in this embodiment is that the device 500 employs a resistive heating arrangement for heating the first aerosol-forming substrate. The resistive heating arrangement comprises a heater blade 502 electrically connected to the rechargeable battery. The heater blade comprises electrical tracks 504 formed on a thermally conductive substrate 506. The electrical tracks are conductive and formed of a material having suitable resistivity to heat up when an electrical current is passed through. The heater blade 502 protrudes upwards from the closed end of the cavity 105 such that, when an aerosol-generating article 501 is received in the cavity 105, the heater blade 502 penetrates the aerosol-generating article to be located within the first aerosol-forming substrate. In use, the control electronics 104 controls the supply of electrical power from the rechargeable battery 103 to the heater blade 502. This causes the electrical tracks 504 to heat up and that heat is transferred to the thermally conductive substrate 506 and the first aerosol-forming substrate of the aerosol-generating article. The control electronics 104 are configured so as to adjust the temperature of the heater blade 502 according to a predetermined thermal profile.

Otherwise, the aerosol-generating device 500 operates similarly to the aerosol-generating device 100, with the aerosol evolved from the first aerosol-forming substrate being entrained in air passing through the primary airflow path to mix with air passing through the secondary airflow path in the mixing region, downstream of the first aerosol-forming substrate, to then be inhaled by a user.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number "A" is understood as "A"±10% of "A". Within this context, a number "A" may be considered to include numerical values that are within general standard error for the measurement of the property that the number "A" modifies. The number "A", in some instances as used in the appended claims, may deviate by the percentages enumerated above provided that the amount by which "A" deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating system comprising:

an aerosol-generating device for simultaneously generating an aerosol from a first aerosol-forming substrate and an aerosol from a second aerosol-forming substrate, the aerosol-generating device comprising a device housing, the device housing defining:

a first substrate receiving portion configured to receive the first aerosol-forming substrate and a second substrate receiving portion configured to receive the second aerosol-forming substrate, a primary airflow path extending through the first substrate receiving portion, and a secondary airflow path extending through the aerosol-generating device such that, in use, the secondary airflow path is in fluidic communication with the second aerosol-forming substrate received in second substrate receiving portion, wherein the secondary airflow path merges with the primary airflow path at a junction downstream of the first substrate receiving portion; and the aerosol-generating system further comprising:

an aerosol-generating article comprising the first aerosol-forming substrate, a rod, and an exterior wall, wherein the first aerosol-forming substrate is receivable in the first substrate receiving portion of the aerosol-generating device, and a cartridge comprising the second aerosol-forming substrate, the cartridge being receivable in the second substrate receiving portion, wherein the exterior wall comprises a fluid-permeable portion downstream of the first aerosol-forming substrate.

2. The aerosol-generating system according to claim 1, wherein the device housing comprises a cavity wall defining a cavity, at least a portion of the cavity wall forming the first substrate receiving portion.

3. The aerosol-generating system according to claim 2, wherein the cavity wall comprises a fluid-permeable region downstream of the first substrate receiving portion, the second airflow path extending through the fluid-permeable region.

4. The aerosol-generating system according to claim 3, wherein the fluid-permeable region is defined by regions of the cavity wall being formed of one or more of a porous material, a plurality of slits, and a plurality of holes.

5. The aerosol-generating system according to claim 3, wherein the fluid-permeable region is an annular band formed in the cavity wall.

6. The aerosol-generating system according to claim 2, wherein the cavity is provided with an open end and a closed end, the cavity being configured to receive the first aerosol-forming substrate via the open end in a longitudinal direction.

7. The aerosol-generating system according to claim 6, wherein the secondary airflow path is substantially perpendicular to the longitudinal direction where the secondary airflow path merges with the primary airflow path.

8. The aerosol-generating system according to claim 1, wherein the aerosol-generating device further comprises a first heating means configured, in use, to heat the first aerosol-forming substrate received in the first substrate receiving portion.

9. The aerosol-generating system according to claim 8, wherein the first heating means comprises an inductor coil adjacent to or surrounding the first substrate receiving portion, and wherein the aerosol-generating device further comprises a power supply configured to supply an alternating current to the inductor coil.

10. The aerosol-generating system according to claim 9, wherein the first substrate receiving portion comprises a susceptor material.

11. The aerosol-generating system according to claim 8, wherein the first heating means comprises a resistive heater and a power supply configured to supply current to the resistive heater.

12. The aerosol-generating system according to claim 8, further comprising a second heating means configured, in use, to heat the second aerosol-forming substrate received in the second substrate receiving portion.

13. The aerosol-generating system according to claim 1, wherein the device housing of the aerosol-generating device comprises a cavity wall defining a cavity, at least a portion of the cavity wall forming the first substrate receiving portion, wherein the cavity wall comprises a fluid-permeable region downstream of the first substrate receiving portion, and wherein the fluid-permeable portion of the rod is configured to be coincident with the fluid-permeable portion of the cavity wall when the aerosol-generating article is received in the cavity.

* * * * *